US009744397B2

(12) United States Patent
Pagano

(10) Patent No.: US 9,744,397 B2
(45) Date of Patent: Aug. 29, 2017

(54) MULTI-RESISTANT STRETCH BAND RING FOR FITNESS BALLS

(71) Applicant: Paul Pagano, St. Petersburg, FL (US)

(72) Inventor: Paul Pagano, St. Petersburg, FL (US)

( * ) Notice: Subject to any disclaimer, the term of this patent is extended or adjusted under 35 U.S.C. 154(b) by 87 days.

(21) Appl. No.: 14/808,496

(22) Filed: Jul. 24, 2015

(65) Prior Publication Data

US 2017/0021220 A1 Jan. 26, 2017

(51) Int. Cl.

| | |
|---|---|
| ***A63B 21/02*** | (2006.01) |
| ***A63B 21/055*** | (2006.01) |
| ***A63B 21/00*** | (2006.01) |
| ***A63B 21/04*** | (2006.01) |
| ***A63B 23/035*** | (2006.01) |
| ***A63B 23/12*** | (2006.01) |
| ***A63B 41/00*** | (2006.01) |
| ***A63B 22/18*** | (2006.01) |
| *A63B 21/16* | (2006.01) |

(52) U.S. Cl.

CPC .... *A63B 21/0557* (2013.01); *A63B 21/00061* (2013.01); *A63B 21/0442* (2013.01); *A63B 21/0552* (2013.01); *A63B 21/4035* (2015.10); *A63B 22/18* (2013.01); *A63B 23/03541* (2013.01); *A63B 23/1209* (2013.01); *A63B 41/00* (2013.01); *A63B 21/00069* (2013.01); *A63B 21/16* (2013.01); *A63B 23/1281* (2013.01); *A63B 2208/0204* (2013.01); *A63B 2208/0233* (2013.01)

(58) Field of Classification Search

CPC ..... A63B 21/0552

See application file for complete search history.

(56) References Cited

U.S. PATENT DOCUMENTS

| | | | | |
|---|---|---|---|---|
| 5,735,776 | A | 4/1998 | Swezey et al. | |
| 5,810,700 | A | 9/1998 | Orcutt | |
| 5,833,587 | A * | 11/1998 | Strong | A63B 21/154 482/121 |
| 6,547,703 | B1 | 4/2003 | Swezey et al. | |
| 6,702,726 | B2 * | 3/2004 | Lin | A63B 21/154 446/220 |
| 6,835,168 | B2 | 12/2004 | Huang | |
| 7,344,487 | B2 | 3/2008 | Carter et al. | |
| 7,678,027 | B2 | 3/2010 | Sanghavi | |
| 2005/0187080 | A1 * | 8/2005 | Bowser | A63B 21/04 482/121 |

* cited by examiner

*Primary Examiner* — Loan H Thanh
*Assistant Examiner* — Rae Fischer
(74) *Attorney, Agent, or Firm* — Harpman & Harpman

(57) ABSTRACT

An exercise apparatus having a resilient band attachment assembly for use with an exercise ball. An exercise ball engagement ring provides multiple attachment points for resilient bands selectively and adjustably secured thereto. During use, a user rests a portion of their body on the exercise ball while pulling the resistant straps elongating same for varied resistance depending on strap length, diameter and attachment point within the ball engagement ring.

8 Claims, 4 Drawing Sheets

MULTI-RESISTANT STRETCH BAND RING FOR FITNESS BALLS

BACKGROUND OF THE INVENTION

1. Technical Field

This invention is related to the field of exercise devices for increasing strength and physical conditioning. Such exercise devices include a large exercise ball to provide a body engagement platform for a variety of physical exercises and resilient straps that provide resistance when pulled by the user from a fixed point.

2. Description of Prior Art

Prior art devices of this type can be seen in U.S. Pat. Nos. 5,735,776, 5,810,700, 6,547,703, 6,835,168, 7,344,487, and 7,678,027.

In U.S. Pat. No. 5,735,776 an isometric exercise ball with an attached loop strap is disclosed providing a pair of oppositely disposed attached loop straps for physical engagement during exercise.

U.S. Pat. No. 5,810,700 claims an exercise ball with stretchable straps wherein a pair of straps are secured around the exercise ball with a resistant member extending therefrom.

U.S. Pat. No. 6,835,168 discloses an exercise ball device having a ball and a pair of elastic cables with end hooks which can be retained on a treadle providing a base on which the user stands grasping the ball on the elastic cables.

U.S. Pat. No. 7,344,487 illustrates an exercise system having an inflatable exercise ball with a bore extending there through having a resilient exercise strap there within having handgrips on oppositely disposed ends extending from the ball.

U.S. Pat. No. 7,678,072 shows a ball exerciser for arms and torso having a dome like housing engageable on a ball. The housing has a restraint member attached thereto for receiving the hand of a user.

SUMMARY OF THE INVENTION

An exercise apparatus for use on a large fitness ball. The exercise device having a plurality of resilient band engagement slots for receiving and temporarily retaining resilient resistant bands with handgrips. The exercise apparatus provides a ring configuration which is engageable on a portion of the exercise ball defining an annular attachment platform thereabout for selectively receiving the independent resistant bands temporarily positioned anywhere there around by engagement within the engagement slots. A variety of exercises are enabled by the bands positioning relative the ball as well as modified exercise ball configurations.

DETAILED DESCRIPTION OF THE INVENTION

Figure 1:
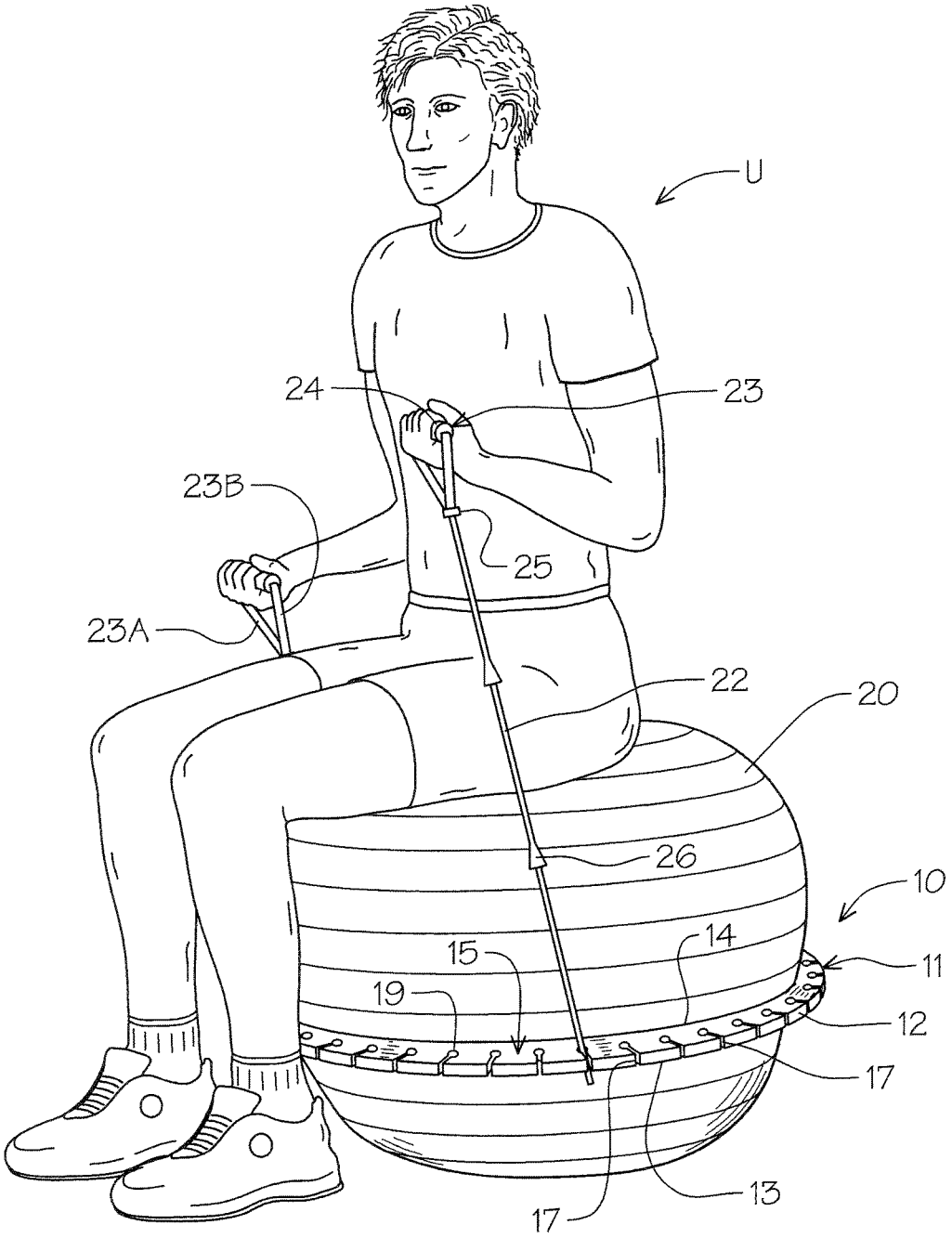
FIG. 1 is a graphic representation of the exercise device of the invention in use on a fitness ball by a user.
Figure 2:
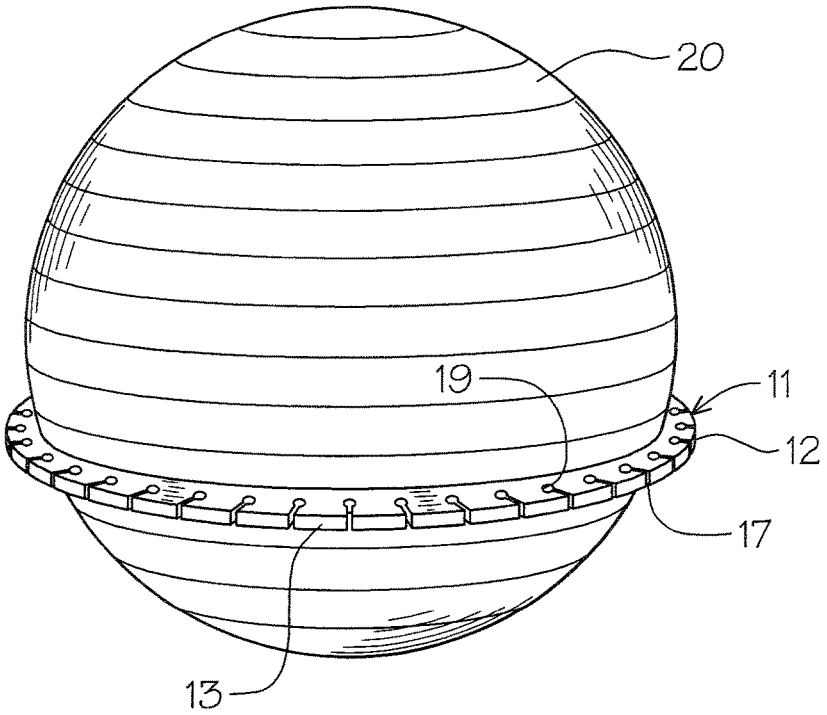
FIG. 2 is a front perspective view of the exercise device on the fitness ball prior to resistant band engagement placement.
Figure 3:
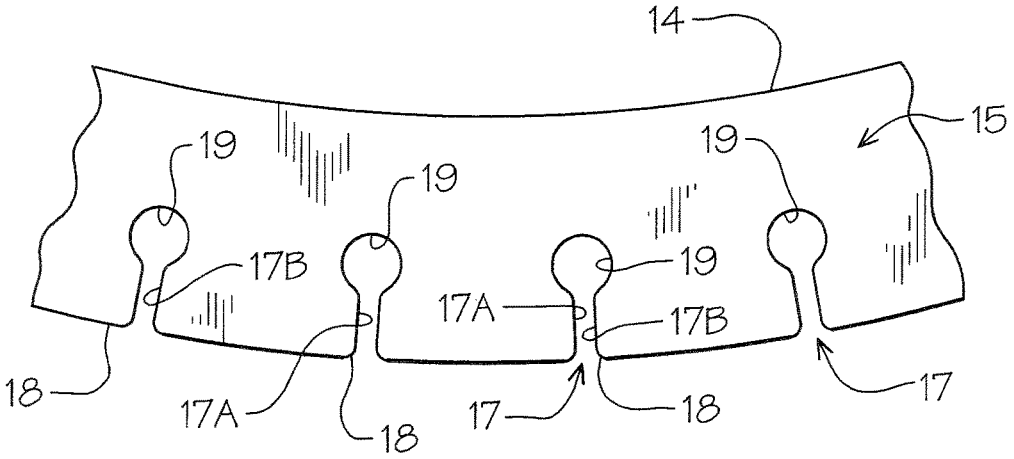
FIG. 3 is an enlarged partial top plan view of the engagement retainment slots in the exercise device.

Referring to FIGS. 1-3 of the drawings, the exercise device 10 of the invention can be seen having a ring platform 11 with a main body member 12 defining an outer annular perimeter edge 13 and an oppositely disposed ball engagement interior annular edge 14. The ring platform 11 has a generally flat top surface 15 and correspondingly oppositely disposed flat bottom surface 16 in its preferred form chosen for illustration in this example.

The ring platform 11 has a plurality of contoured band retaining slots 17 extending inwardly from its outer perimeter edge 13 as best seen in FIG. 3 of the drawings. The retainment slots 17 are in spaced annular relation to one another extending thereabout. Each of the contoured retaining slots 17 have a spaced parallel sidewalls 17A and 17B extending inwardly from the perimeter edge 13 with respective round corners 18. The sidewalls 17A and 17B terminate and are intersected by an annular bore 19 extending through the ring platform 11 and is of a diameter greater than that of the spacing between the hereinbefore described sidewalls 17A and 17B. It will be seen that the contoured retainment slots 17 are therefore of a keyhole configuration which will provide for band adjustable retainment as will be described hereinafter.

The ring platform 11 is of an interior open diameter less than that of the diameter of a fitness ball 20 on which it is frictionally positioned for use as seen in FIGS. 1 and 2 of the drawings.

Figure 4:
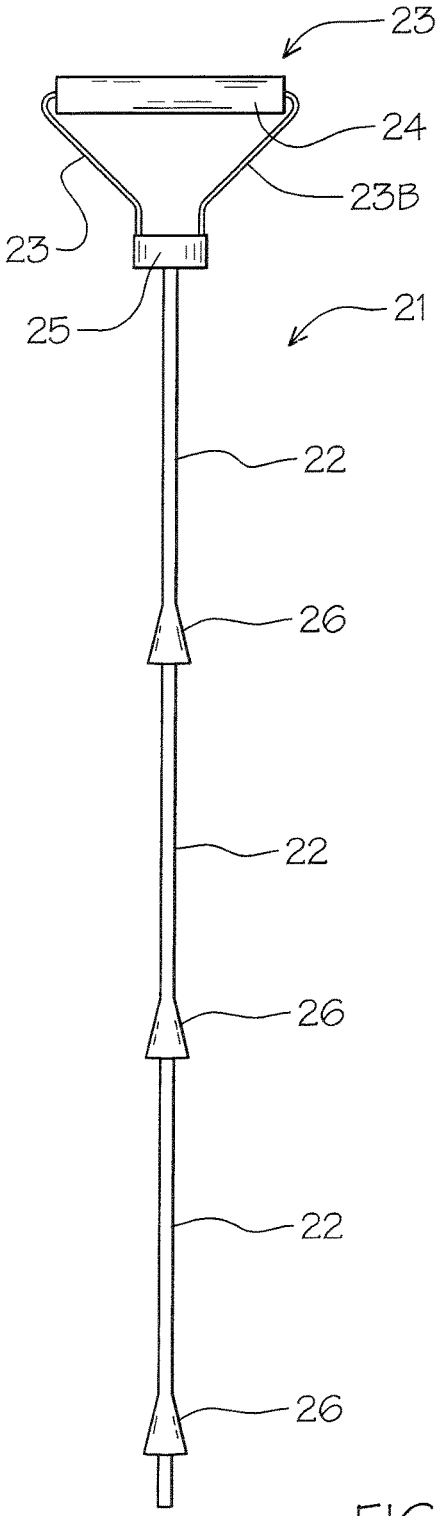
FIG. 4 is a side elevational view of a resilient adjustable resistant band and integrated handgrip.
Figure 5:
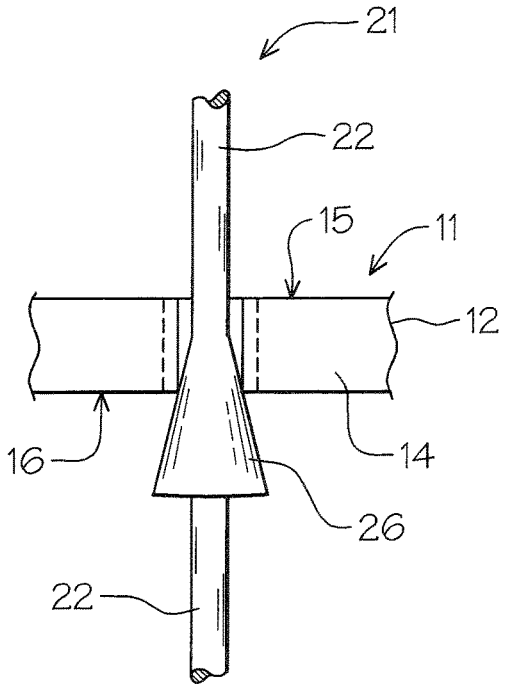
FIG. 5 is a partial enlarged side elevational view of the resistant band slot engagement portion, temporarily retained in the exercise device slot.
Figure 6:
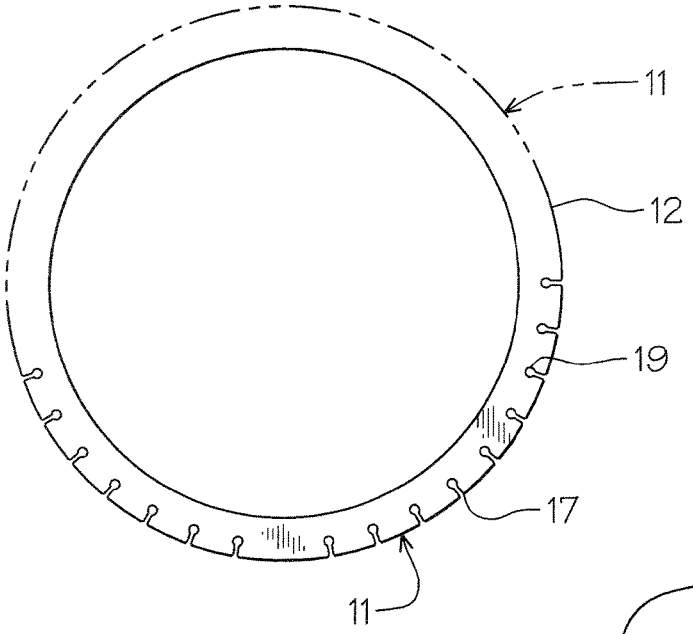
FIG. 6 is a top plan view of the platform resistant band engagement ring of the device.

Referring now to FIGS. 1, 4 and 5 of the drawings, an exercise stretch band assembly 21 can be seen having an elongated cross sectional solid band 22 of resilient synthetic resin material well known within the art. The band 22 has a handgrip 23 attached to one end thereof. The handgrip 23 has a rigid gripping rod 24 with connector straps 23A and 23B extending from its oppositely disposed respective ends to a molded band attachment fitting 25 as best seen in FIG. 4 of the drawings. The elongated band 22 has a plurality of longitudinally spaced enlarged retainment ring engagement fittings 26 formed integrally there along. Each of the ring engagement fittings 26 is of a foreshortened frustoconical configuration defining a base dimension of an annular diameter greater than that of the cross section of the band 22 on which it is formed as best seen in FIG. 5 of the drawings.

The exercise band assembly 21 can therefore be selectively engaged and retained within the respective contoured retainment slots 17 in the angular ring platform 11 by engagement of the correspondingly selected ring engagement fittings 25 thereon effectively varying the overall length of each of the bands 22 as may be required during use as seen, for example, in FIG. 1 of the drawings.

This length adjustment factor is also dependent on the size of the fitness ball 20 which varies within the art.

It will be evident that given the material nature of the stretch band 22 which are similar to a known typical rubber band having unique characteristics of elastic deformation. As such, it will be seen that expediential input force is required to effectively increase the length of the elastic material and the band 22. A variety of different exercises may be achieved utilized by the repositioning of the stretch bands 22 to a different contoured retainment slot 17 positional registration about the ring platform 11 and the band length determined by the selective engagement of the stretch band ring engagement fittings 26 in combination, as required, with the user's orientation on the exercise ball 20. Other variations in band constructional configurations can be achieved to impart additional elongation forced determination by the effective diameter of the basic band 22 and the selection of material, again well within the confines and understandings of those skilled within the art.

Figure 7:
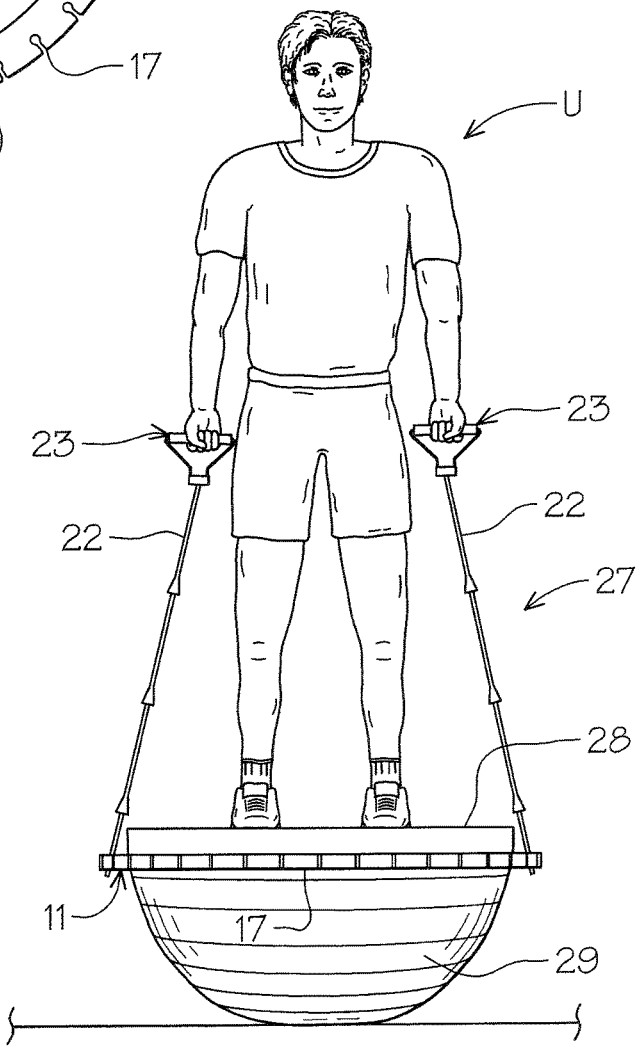
FIG. 7 is a graphic perspective view of an alternate form of the invention with the user standing on a modified ball platform.

Referring now to FIG. 7 of the drawings, a modified exercise device 27 can be seen in which an effective balancing platform 28 is configured on a half spherical exercise ball 29 forming a ground engagement support.

In this example, the hereinbefore described ring platform 11 may also be used and engageable on the half exercise ball 29 as hereinbefore described. Accordingly, the exercise band assembly 21 is in this example adjustably engaged within the ring platform contoured slot 17 as before providing multiple use placement and effective length to accommodate the user U during use. Again, in this example, the user stands balancing on the platform 28 holding onto the oppositely disposed handgrips 23 of the resiliently positioned and selectively arranged bands 22 as previously described providing a unique and novel exercising opportunity utilizing essentially the same basic elements as the preferred form of the invention as described in the exercise device 10 previously.

It will thus be seen that a new and novel multiple resistant stretch band ring for fitness balls and the like has been illustrated and described and that various changes and modifications may be made thereto without departing from the spirit of the invention, therefore I claim:

1. An exercise system for use with an exercise ball, said exercise system comprising;

a flat ring platform fits over said exercise ball;

a plurality of radially spaced band engagement slots in said flat ring platform, said band engagement slots extend inwardly from a perimeter outside edge of said flat ring platform;

a plurality of resilient exercise bands selectively retained in said engagement slots; and a handgrip on said exercise bands, and at least one ring engagement fitting on said band in spaced relation to handgrip.

2. The exercise system set forth in claim 1 wherein said flat ring platform has an interior diameter less than that of the exterior diameter of the exercise ball.

3. The exercise system set forth in claim 1 wherein said band engagement slots are in radially spaced relation to one another within said flat ring platform.

4. The exercise system set forth in claim 1 wherein said ring engagement fitting on said band comprises a band area of increased dimension for progressive registration within said respective band engagement slots.

5. The exercise system set forth in claim 1 wherein each of said band engagement slots terminates in an annular bore centered within the band engagement slot having a diameter greater than the width of the band engagement slot.

6. The exercise system set forth in claim 1 wherein each of said resilient exercise bands further comprises, a plurality of said ring engagement fittings in longitudinally spaced relation to one another on said band.

7. An exercise system for a hemispherical base comprising;

a user support disk platform on the hemispherical base;

a horizontally positioned flat ring platform fits on said spherical hemispherical base in spaced relation to said user support disk platform;

a plurality of radially spaced band engagement slots extending inwardly from a perimeter edge of said flat ring platform;

a plurality of resilient exercise bands selectively retained within some of said band engagement slots, a handgrip on each of said exercise bands and multiple ring enlarged slot engagement fittings in longitudinal spaced relation on each of said exercise bands for progressive retainment within said respective band engagement slots in said ring platform in spaced relation to said handgrip.

8. The exercise system set forth in claim 7 wherein each of said band engagement slots terminates in an annular bore within the band engagement slot having a diameter greater than the width of said band engagement slot.

* * * * *